United States Patent [19]

George

[11] 4,061,460

[45] Dec. 6, 1977

[54] PEDAL POWERED POTTER'S WHEEL

[76] Inventor: John George, Box 625, Rte. 11, Tucson, Ariz. 85706

[21] Appl. No.: 702,685

[22] Filed: July 6, 1976

[51] Int. Cl.[2] ..... B28B 1/02

[52] U.S. Cl. ..... 425/459; 272/73

[58] Field of Search ..... 425/263–268, 425/459; 272/73

[56] References Cited

U.S. PATENT DOCUMENTS

| | | | |
|---|---|---|---|
| 696,713 | 4/1902 | Brown | 272/73 X |
| 1,744,607 | 1/1930 | Baine | 272/73 |

FOREIGN PATENT DOCUMENTS

| | | | |
|---|---|---|---|
| 566,778 | 2/1924 | France | 425/268 |

*Primary Examiner*—Robert D. Baldwin

[57] ABSTRACT

A pedal powered potter's wheel is composed of a wheelhead, upon which the potter shapes his pots, mounted upon the upper end of a vertical driveshaft, which is bolted to a horizontal hollow rubber wheel partially filled with water to function as a flywheel. The flywheel is turned counterclockwise by a bicycle wheel vertically pressed down against its outer upper rubber surface at a 90° angle. The bicycle wheel is spun by two chains on two sprockets bolted to each end of the horizontal power transfer shaft. The potter sits before the wheelhead while pushing two pedals welded to a sprocket directly below him which drives a chain turning the nearest sprocket of the power transfer shaft.

2 Claims, 2 Drawing Figures

PEDAL POWERED POTTER'S WHEEL

The present invention relates to potter's wheels and more particularly to a pedal powered potter's wheel utilizing a (a) a hollow rubber wheel, partially filled with water, as the flywheel; (b) a bicycle wheel mounted vertically and pressed down upon the outer rubber surface of the horizontal and counterclockwise turning flywheel; (c) a frame to support the bicycle wheel, flywheel, wheelhead, and potter; (d) a mechanically advantaged footbrake to slow down or stop the flywheel from turning.

The two conventional potter's wheels are the kickwheel and the electric wheel. The kickwheel, with its concrete or plaster flywheel, is very tiring to kick-spin for long periods of time. It is heavy, cumbersome and bulky to disassemble and transport, weighing at least 250 pounds, but it requires no external power source. The electric wheel is dependent upon a 110 volt power source, thus limiting its distribution, and increasing its costs of operation and maintenance.

The present invention is designed to eliminate or reduce the disadvantages of both the kickwheel and the electric potter's wheel by offering a lighter, less cumbersome, readily disassembled and transported potter's wheel that is easy and efficient to operate for long periods of time, and requires no outside power source. It costs virtually nothing to operate, and needs no more maintenance that that required by a bicycle. The pedaling motion, in contrast to the kicking motion, allows the potter's body to be balanced at all times. In addition, the pedal powered potter's wheel provides the potter with better control of his wheelhead speed because of the combined smooth pedaling motion, the momentum of the water in the flywheel, the flywheel, and the even braking capacity of the foot controlled brake. This invention is highly efficient and can generate more than one horsepower of energy when needed because of the combined mechanical advantages of bicycle and flywheel power incorporated herein. It is comparatively less expensive to construct or purchase because it can be built of used and recycled parts readily available in the United States: coaster brake bicycles, bicycle parts, automobile wheels, and metal pipe or angle iron. It thus halves the cost of purchase of an electric potter's wheel, the most expensive wheel currently available.

The principal object of the invention is to provide a potter's wheel that combines and improves upon the advantages of the two existing potter's wheels, without their disadvantages, e.g. to combine ease of operation, independence of conventional power sources, with a highly efficient and easily controlled power transfer to the wheelhead.

Another object is to provide a potter's wheel that can be easily and quickly assembled and disassembled with screw driver and crescent wrench into two major portions, each portable by one man. The disassembled flywheel portion, without water, weighs approximately 65 pounds. The remainder of the invention weighs approximately 100 pounds.

A further objective is to provide a potter's wheel that is less expensive to construct than the two existing wheels, that can be built at home with easily obtainable used and recycled parts, or manufactured en mass at lower cost.

Still another objective is to provide a potter's wheel that costs virtually nothing to operate, e.g. no more maintenance or operating costs than a bicycle requires.

Other objects and advantages of the invention will become better understood hereinafter from a consideration of the specification with reference to the accompanying drawing forming part thereof, and in which like numerals correspond to like parts in the two figures of the invention, and wherein.

Figure 1:
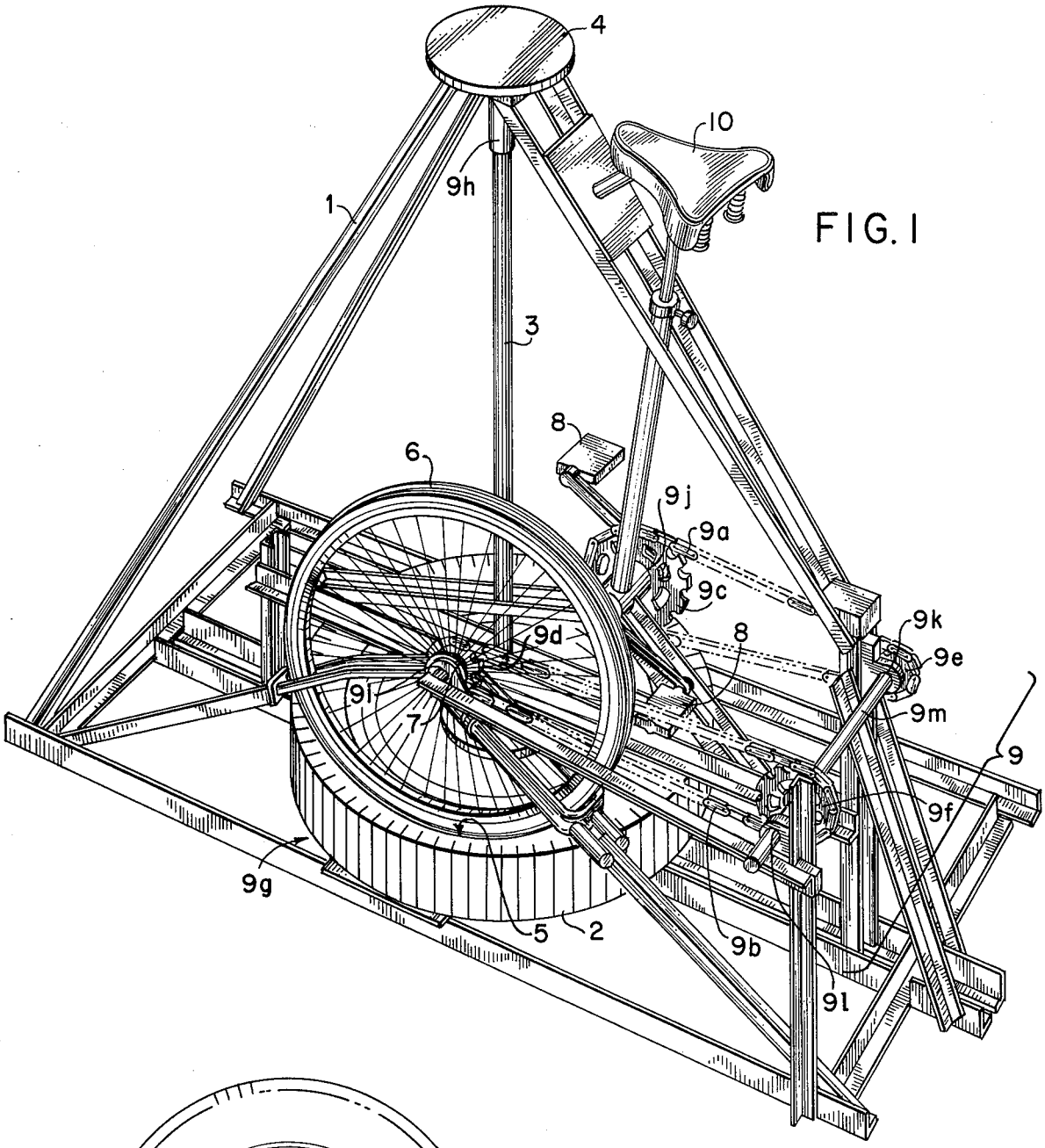
FIG. 1 is a view of the complete invention.
Figure 2:
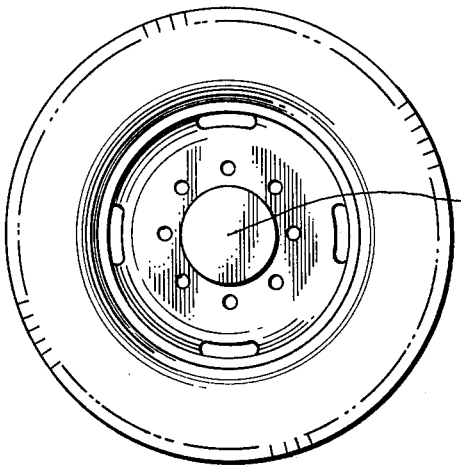
FIG. 2 is a detail showing the location of flywheel bearing (9*g*).

Referring to the drawing, FIG. 1, the pedal powered potter's wheel characterizing the present invention comprises a steel framework 1 bolted together, supporting a horizontal hollow rubber flywheel 2, partially filled with water and air, turning on bearing 9*g*, see FIG. 2, and bolted to the base of a trued vertical drive shaft 3, which in turn is bolted to the base of the potter's wheelhead 4. The flywheel, trued vertical drive shaft, and potter's wheelhead are all turned counterclockwise by the vertical bicycle wheel 6, pressed down at a 90° angle 5 against the outer upper rubber surface of the aforementioned flywheel. The above mentioned bicycle wheel contains a coaster brake 7 in its wheel hub, which is activated by counterclockwise foot pressure on the foot pedals 8. These foot pedals are pushed by the seated potter in a clockwise motion to activate the chain driven power system, (parts 9*a* through 9*m*). The foot pedals are attached to a crank in turn attached to a sprocket 9*c*, revolving on bearing 9*j*. The preceding sprocket is connected to sprocket 9*e* by bicycle chain 9*a*. Sprockets 9*e* and 9*f*, revolving on bearings 9*k* and 9*l* are attached to both ends of the power transfer shaft 9*m*. Sprocket 9*f* is connected to sprocket 9*d* by bicycle chain 9*b*. Sprocket 9*d*, revolving on bearing 9*i*, is built into the above mentioned bicycle wheel 6, which is turned clockwise by the aforesaid chain driven power drive system. The potter, whose foot pedaling motion activates the chain driven power drive system, sits on seat 10 before the above mentioned wheelhead 4, revolving on bearing 9*h*, which, when operating, spins counterclockwise, thus allowing the potter to throw and form clay on the pedal powered wheelhead.

Having thus described the invention, it is to be understood that certain modifications in the construction and arrangement of the parts thereof will be made, as deemed necessary, without departing from the scope of the appended claims.

I claim:

1. A pedal powered potter's wheel comprising in combination:

a. a frame;

b. a hollow, rubber flywheel containing water and air rotatably mounted within said frame about a vertical axis, the greatest bulk weight of said flywheel located toward the outer edge thereof;

c. a wheelhead shaft rotatably mounted within said frame along said vertical axis, said shaft being removably attached to a potter's wheelhead at its upper end and a rotatable means at its lower end;

d. a bicycle power drive wheel rotatably mounted within said frame about a horizontal axis such that the outer portion of said drive wheel pressingly contacts an upper portion of said flywheel at a 90° angle, and;

e. means including foot pedals on said drive wheel for actuating said drive wheel and in turn rotating said flywheel, wheelhead shaft and potter's wheel.

2. A pedal powered potter's wheel as claimed in claim 1 wherein said means for actuating said drive wheel includes a chain drive system with coaster brake to control rotational speed of said flywheel.

* * * * *